US005460028A

United States Patent [19]

Werner et al.

[11] Patent Number: 5,460,028

[45] Date of Patent: Oct. 24, 1995

[54] CIRCUIT ARRANGEMENT FOR CONDITIONING THE SIGNAL OF A MEASURING SENSOR

[75] Inventors: Peter Werner, Wiernsheim; Hermann Hemminger, Markgröningen; Beate Glöckner, Mühlacker; Gerard Byrne, Rottenburg; Stephan Johne, Ludwigsburg, all of Germany

[73] Assignee: Robert Bosch GmbH, Stuttgart, Germany

[21] Appl. No.: 341,230

[22] Filed: Dec. 5, 1994

[30] Foreign Application Priority Data

Dec. 4, 1993 [DE] Germany ..... 43 41 390.0

[51] Int. Cl.[6] ..... F02B 3/08

[52] U.S. Cl. ..... 73/1 R; 123/694

[58] Field of Search ..... 73/1 R, 1 G, 23.31, 73/23.32; 123/694

[56] References Cited

U.S. PATENT DOCUMENTS 4,177,770 12/1979 Anderson .

4,721,957 1/1988 Buttle ..... 324/76.11

*Primary Examiner*—R. Raevis

*Attorney, Agent, or Firm*—Walter Ottesen

[57] ABSTRACT

The invention is directed to a circuit for conditioning the output signal of a measuring sensor for further processing in a control apparatus which has a fixed ground potential which does not necessarily correspond to the ground potential of the measuring sensor. A conditioning circuit is provided which can be integrated on a chip and has the following characteristics. The conditioning circuit compensates for the fluctuating ground offset between exhaust gas probe and control apparatus ground when utilizing an exhaust gas probe burdened with a potential. The circuit arrangement includes an external circuit which can be changed to influence the input signal to the conditioning circuit. With this changeable external circuit, the output signal of the circuit arrangement can be so modified that the control apparatus outputs an output voltage with offset and an output voltage without offset. In the case of the external circuit for an output voltage without offset, an offset is impressed upon the input voltage which is then again subtracted at the output with an amplification factor so that the absolute value of the impressed offset has no influence on the output voltage.

10 Claims, 2 Drawing Sheets

CIRCUIT ARRANGEMENT FOR CONDITIONING THE SIGNAL OF A MEASURING SENSOR

FIELD OF THE INVENTION

The invention relates to a circuit for conditioning the output signal of a measuring sensor for further processing in a control apparatus. The control apparatus has a fixed ground potential which does not necessarily correspond to the ground potential of the sensor.

BACKGROUND OF THE INVENTION

An exhaust gas sensor is mounted in the exhaust of an internal combustion engine and defines an example of such a sensor. The signal of this sensor is processed in a control apparatus having a ground potential which can be offset with respect to the ground potential at the location where the exhaust gas probe is installed. The reason for this possible offset is presented below.

Currents flow between the vehicle battery and the internal combustion engine. These currents, for example, supply the ignition equipment or are generated by a generator for charging the battery. The corresponding current loop is closed via the chassis, engine and the ground connection between the engine and the negative terminal of the battery and has a finite resistance. This resistance leads, in combination with the fluctuating current flow, to a potential difference between engine ground, chassis ground and battery ground. This potential difference fluctuates in dependence upon current intensity. The potential difference identified in the following as ground offset is between chassis ground and engine ground and typically is −0.3 to 1 Volt.

The following is based upon a so-called chassis ground concept; that is, the ground potential of a control apparatus corresponds to the ground potential of the chassis. The control apparatus is used to control functions of the internal combustion engine such as fuel metering and ignition. The offset between this ground potential and the ground potential of an exhaust gas probe mounted in the exhaust gas line comes about because the exhaust gas probe is often not insulated electrically with respect to the exhaust gas line and therefore is to some extent burdened by the ground potential of the engine.

The signal line is connected to the control apparatus. In combination with this signal line, a ground offset having the order of magnitude described can greatly falsify the signal of the exhaust gas probe because this signal can have a magnitude in the range of −80 mV to approximately 1 Volt and therefore have the order of magnitude of the possible ground offset.

U.S. Pat. No. 4,177,770 discloses a circuit for eliminating the above-described ground offset. The ground potential of the voltage supply for differential amplifiers in the control apparatus is tied to the ground potential of the exhaust gas probe. This tie-in is utilized to compensate the ground offset between the ground of the control apparatus and the ground of the exhaust gas probe.

A further possibility for avoiding the above-described ground offset comprises electrically separating the exhaust gas probe ground from the ground of the engine and connecting the exhaust gas probe ground, electrically insulated, to the control apparatus.

Separate from the problem of the ground offset, it is further known to impress a defined offset voltage onto the signal of the exhaust gas probe via a conditioning circuit and to further process the resulting total voltage. The offset is selected so great that the resulting total voltage is positive even for negative output voltage of the exhaust gas probe. This makes the evaluation of negative probe voltages possible.

Furthermore, it is possible by means of an impressed offset to compensate negative ground offset with a differential amplifier.

Further separate from the problem of the ground offset, it is known to impress a counter voltage onto the signal of the exhaust gas probe. The counter voltage has an influence on the resulting total voltage which is dependent upon the temperature of the exhaust gas probe and therefore on its internal impedance. For cold probes, only the counter voltage operates on the probe signal.

Likewise separate from the problem of ground offset, exhaust gas signal conditionings taking place without defined offset voltage are known. In this case, the output signal of the conditioning circuit should be a linear function of the input voltage without offset. The proportionality between the exhaust gas probe signal and the output signal of the conditioning circuit obtained thereby, affords the advantage that the original exhaust gas probe signal can be regenerated or again acquired in a simple manner, principally by means of a voltage divider from the output signal of the conditioning circuit. In this way, the original lambda signal can be outcoupled, that is, a signal is obtained for use by a service station which indicates directly the oxygen content of the exhaust gas.

SUMMARY OF THE INVENTION

It is an object of the invention to provide a circuit for conditioning the output signal of an exhaust gas probe. The circuit can be integrated on a chip as an IC. It is also an object of the invention to provide such a circuit having the characteristics described below:

(a) when utilizing an exhaust gas probe burdened by a potential, the conditioning circuit should compensate the fluctuating ground offset between the ground of the exhaust gas probe and the ground of the control apparatus;

(b) the output signal of the conditioning circuit should be so changeable that the control apparatus can be selectively supplied in a first case with an output voltage having an offset and, in a second case, with an output voltage without an offset. The output signal is here intended to be changed via a changing output circuit which influences the input signal of the conditioning circuit. Stated otherwise, the conditioning circuit should impress a counter voltage on the probe signal which, in the first case, is visible as an offset in the output signal of the conditioning circuit and which, in the second case, is subtracted completely by the conditioning circuit so that a defect of the counter voltage is likewise completely eliminated by subtraction. If the input voltage of the conditioning circuit is identified as Ue, the output voltage as Ua, the offset as Uo and the defect as Uf, then this requirement can be expressed with the following equation:

$$Ue=Ui+Uo+Uf \Rightarrow Ua=X*(Ue+Uo+Uf)-X*(Uo+Uf)$$ or, more specifically, $Ua=X*Ue$.

This task is solved by providing a circuit arrangement for conditioning a signal (U1) of a measuring sensor having a ground potential so that the sensor signal (U1), which is referred to the ground potential, can be further processed in a control apparatus having a control apparatus ground potential which can be offset from the ground potential of the measuring sensor by an amount (Um), the circuit arrangement including: a conditioning circuit including: a first input connected to the sensor ground and a first output; means for generating a first offset Ug; and, means for forming a sum potential of the ground potential of the measuring sensor and the first offset Ug and for applying the sum potential to the first output; coupling means for logically combining the sum potential and the sensor signal (U1) to define a signal (Ue) as a linear function of the sensor signal (U1) supplemented by an offset (b) other than zero and the signal (Ue) being defined by the equation: Ue=a*U1+b wherein the signal Ue is referred to the ground potential of the measuring sensor; the conditioning circuit further including a second input for receiving the signal (Ue) to form a potential at the second input corresponding to a potential (Ue+Um) referred to the control apparatus ground; and, ancillary means having a first input for receiving the potential (Ue+Um) via the second input of the conditioning circuit and having a second input for receiving the ground potential of the control apparatus; and, the ancillary means including means for converting the potential (Ue+Um) and the ground potential of the control apparatus into an output signal (Ua), which is referred to the ground potential of the control apparatus and is independent of the amount (Um) and is a linear function of the measuring signal (U1) with an offset B defined as: Ua=A*U1+B wherein the offset B can be set to a value zero or to a value other than zero in dependence upon the configuration of the coupling means; and, the conditioning circuit having a second output for outputting the output signal Ua.

Such a conditioning circuit can be applied to various desired applications by changing the external circuitry. These applications include:

(a) evaluation with offset (B≠0)

(b) evaluation without offset (B=0).

Integrating the conditioning circuit on one chip affords the advantage that, in both cases, only one IC must be manufactured with which, in principle, the signal of potential-free exhaust gas probes can be evaluated; that is, exhaust gas probes having ground potentials not offset with respect to the ground of the control apparatus.

A further significant advantage of the circuit is that, when selecting a signal conditioning without offset, the negative ground offset can be compensated with the impressed counter voltage. For a cold probe, only the counter voltage is effective at the output of the conditioning circuit; whereas, the absolute value of the counter voltage (possibly burdened by an error) for a warm probe has no influence on the output signal of the conditioning circuit because the offset impressed at the input is multiplied by the amplification factor of the circuit and is subtracted at the output. In this way, a possible error of the offset voltage is eliminated.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
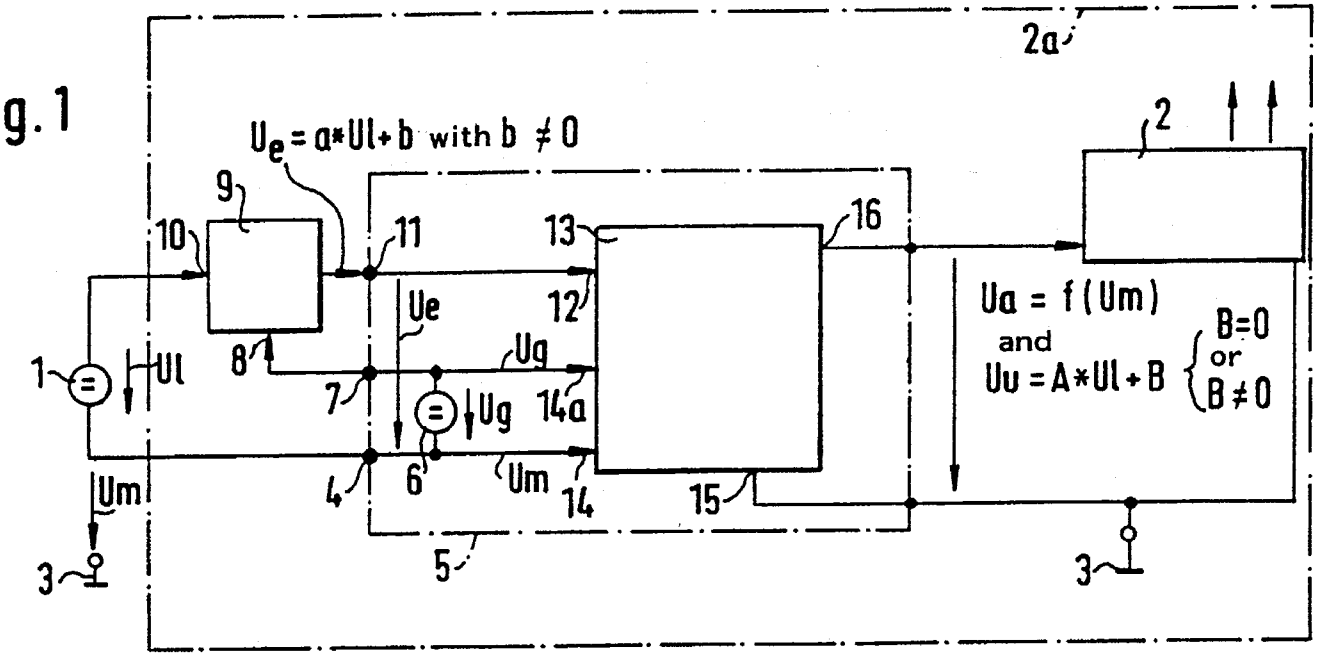
FIG. 1 is a circuit block diagram of an embodiment of the circuit of the invention for conditioning the signal of a measuring probe.

Reference numeral 1 in FIG. 1 identifies a measuring sensor which supplies a signal U1. The measuring sensor can, for example, be an exhaust gas probe mounted in the exhaust gas system of an internal combustion engine. In this case, the conditioned signal of the exhaust gas probe operates to control functions of the engine via a control apparatus 2. Reference numeral 3 symbolizes the electric ground of the control apparatus. The potential of this ground should have the value 0. The voltage arrow Um between measuring sensor 1 and control apparatus ground 3 defines the ground offset between control apparatus and measuring sensor. The amount Um is, at the same time, a value for the ground potential of the measuring sensor.

This ground potential is supplied to a first input 4 of a conditioning circuit 5 which includes, inter alia, a voltage source 6. This voltage source 6 supplies a voltage Ug and is so connected between the first input 4 and a first output 7 that a potential Um+Ug is applied to this output. The potential Um+Ug is referred to the ground of the control apparatus and is supplied to an input 8 of a means 9 for coupling. The means 9 has an input 10 to which the signal U1 of the measuring sensor 1 is applied. The means 9 for coupling forms a signal Ue from these signals and the signal Ue defines a linear function of U1 supplemented by an offset (b) unequal to zero (Ue=a*U1+b). Different values for (a) and (b) can be fixed in accordance with the configuration of the means 9. The possibility of fixing the offset (b) is essential. The signal Ue is conducted via a second input 11 of the conditioning circuit to the input 12 of a further means 13. Additional signals can be supplied to means 13 as follows: at least the ground potential Um of the measuring sensor via the input 14, the value of the voltage Ug via the connection **14*a* and the ground potential of the control apparatus via the input 15**.

The additional means 13 does the following: amplifies (depending on circuitry) the input signal Ue, compensates the ground offset between the converted measuring sensor signal Ue and the control apparatus ground and subtracts from the signal Ue (which is further processed depending upon amplification) a permanently adjusted additional offset with respect to the ground of the measuring sensor. The input offset (b) can be compensated by subtracting the additional offset, which is permanently adjusted relative to the ground of the measuring sensor, in dependence upon how the input offset (b) is determined by the means 9 for coupling.

If this is the case, then the additionally processed additive offset (b) corresponds to the fixed adjusted offset to be subtracted and an output voltage Ua is applied to the output 16 of the additional means. This output voltage Ua is referred to the ground of the control apparatus and is no longer dependent upon the ground offset Um and is proportional to the measuring sensor signal U1 (Ua=A*U1).

If this is not the case, then the fixedly adjusted offset to be subtracted does not compensate the input offset (b) so that the output signal of the additional means 13 exhibits an offset B (*Ua=A*Ui+B*) in addition to the proportionality to U1. In this case too, Ua exhibits no dependency on ground offset Um.

Figure 2:
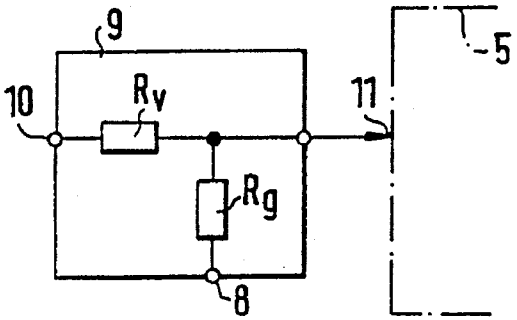
FIG. 2 is a detail view showing the coupling means of the circuit of FIG. 1.

FIG. 2 shows an embodiment of the means 9 for coupling the measuring sensor signal U1 and voltage Ug. Two resistors Rv and Rg divide the voltage U1-Ug lying between the terminals 10 and 8 so that the output voltage Ue defines a linear function ($Ue=a*U1+b$) of the input voltage U1. (a) is defined by Rg/(Rv+Rg) and the offset (b) is defined by Rv/(Rv+Rg). The output voltage Ue is referred to the ground potential of the measuring sensor.

Figure 3:
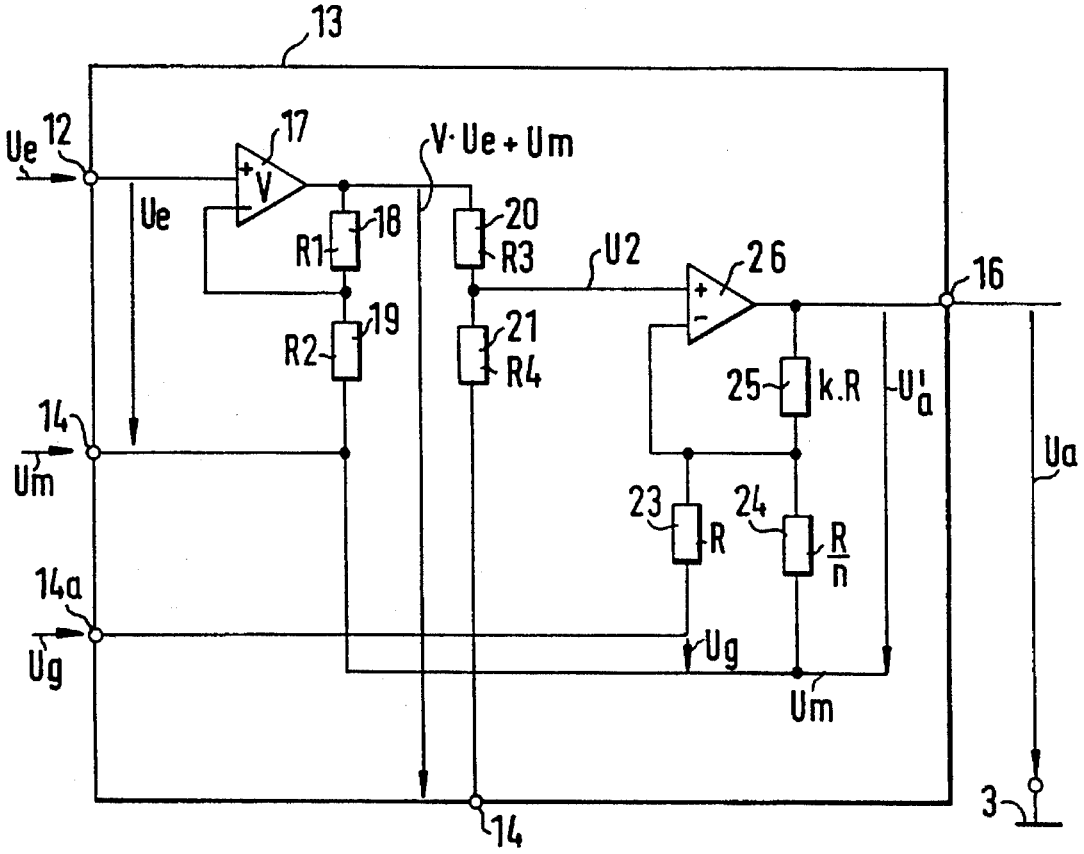
FIG. 3 is a detail view of block 13 of FIG. 1.

FIG. 3 shows an embodiment of the further means 13. The means 13 in this embodiment includes an operational amplifier 17, which is wired as an electrometer amplifier utilizing resistors 18 (R1) and 19 (R2), a voltage divider defined by resistors 20 (R3) and 21 (R4), a voltage source 22 and an operational amplifier 26. The operational amplifier 26 is wired as a subtractor including resistors 23 (R), 24 (R/n) and 25 (k*R) having an electrometer input.

In the circuit shown, the sum V*Ue+Um lies across the output of the operation amplifier 17 and the ground potential of the control apparatus. This sum includes the ground potential Um of the measuring sensor, supplied via terminal 14, and the signal Ue amplified by a factor V. The magnitude of V is determined by the selection of the resistors R1 and R2 to be V=(1+R1/R2).

This voltage is divided by the voltage divider comprising resistors R3 and R4 in the ratio d=R4/(R3+R4) and is supplied to the inverting input of the operational amplifier 26. In the circuit shown, the output voltage U'a is defined as the difference of the potential U2 at the non-inverting input and the potential Ug when the potentials are referred to the ground potential Um of the measuring sensor. The output signal U'a is referred to the ground potential of the sensor and the potential U2 is weighted by a factor (1+k+k*n). The potential Ug is weighted by the factor k.

Referred to the ground potential of the control apparatus, the output voltage Ua of the conditioning circuit satisfies the following equation:

$$Ua=U'a+Um=(l+k+k*n)*((V*Ue+Um)*d-Um)-k*Ug+Um.$$

The term ((V*Ue+Um)*d−Um) is the potential U2 at the non-inverting input of the operational amplifier. The potential U2 is referred to Um. Ug corresponds to the offset adjusted with respect to ground potential Um of the measuring sensor.

The resistors 20, 21 and 23 to 25 are so matched to each other that the condition (l+k+k*n)=1/(l−d) is satisfied. In this case, Ua is independent of Um. The output signal Ua of the conditioning circuit 13 then satisfies the equation:

$$Ua=(l+k+k*n)(V*Ue)-k*Ug$$

wherein the output signal Ua is referred to the ground of the control apparatus.

Stated otherwise, the described configuration of the voltage divider (d) and the operational amplifier circuit satisfies the first requirement of the conditioning circuit 13 according to which the ground offset Um between the ground potential of the measuring sensor and the ground potential of the control apparatus is to be eliminated.

The second requirement concerns the dependency of the output signal of the conditioning circuit from the changing external circuitry. Ua should be so changeable by this external circuitry that the control apparatus should receive, on the one hand, an output voltage with offset and, on the other hand, an output voltage without offset.

The changing external circuitry first relates to the signal Ue which is defined as Ue=a*Ul+b. The constants (a) and (b) can be determined by the selection of the resistors Rv and Rg.

If the output signal Ua of the conditioning circuit is to contain no offset B, then (b) has to be so determined via the selection of Rv and Rg that (l+k+k*n)*V*b=k*Ug, because then Ua=A*U1 wherein the proportionality factor A is computed as (l+k+k*n)*V*a. Stated otherwise, the output signal Ua has no offset B when Rv/(Rv+Rg)=k/(l+k+k*n).

The remaining variables are constant except for Rv and Rg. An output signal Ua of the conditioning circuit results in dependence as to how the external circuitry (Rv, Rg) is configured with the output signal Ua being linearly dependent from the signal U1 of the measuring sensor or, additionally, having an offset B pregiven by the external circuitry.

Figure 4:
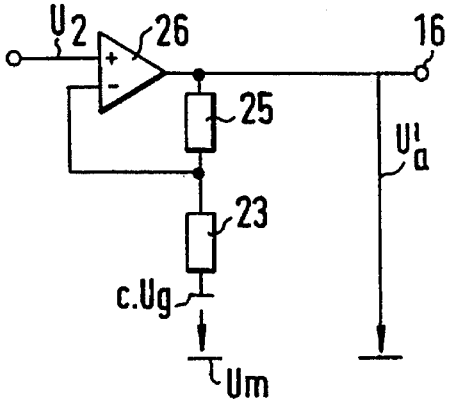
FIG. 4 is a schematic circuit diagram of a variation of the circuit shown in FIG. 3.

FIG. 4 shows a departure from the embodiment of FIG. 3. In this embodiment, compared to FIG. 3, the resistor (R/n) 24 is omitted. To some extent, FIG. 4 proceeds from FIG. 3 if for n of FIG. 3, n is allowed to approach zero as a limit value. In this way, the resistance (R/n) 24 increases to infinite values which is equivalent to a non-conductive element and therefore an element which cannot be shown. Furthermore, the resistor 23 is no longer connected to the voltage Ug and is instead connected to a voltage c*Ug wherein the factor (c), as explained below, can be greater or less than 1.

The output voltage Ua of the so-modified circuit satisfies the equation:

$$Ua=V'*((V*Ue+Um)*d-Um-c*Ug)+Um+c*Ug$$

referred to the ground potential of the control apparatus. (d) is determined by the voltage divider from the resistors R3 and R4 to yield d=(R4/(R3*R4). V corresponds to the amplification factor of the amplifier circuit which comprises the operational amplifier 17 and the resistors 18 and 19 shown in FIG. 3. V' corresponds to the amplification factor of the amplification circuit comprising the operational amplifier 26 and the resistors 23 and 25 and Ug corresponds to the voltage Ug of the voltage source 6 of FIG. 1.

The condition V'*(d−1)=1 must be satisfied so that the output signal Ua of the so-modified circuit is independent of the ground offset Um.

Ua can then again be defined as Ua=A*Ul+B wherein B=V*b+c*Ug. If a signal is to be conditioned without offset, then (b) is set via the means for coupling so that B becomes zero. In the embodiment of the means for coupling of FIG. 2, this means the same as the condition (Rv/(Rv+Rg))*V=c. As mentioned further above, a (c) which satisfies this condition can be less, equal to or greater than 1. The condition is satisfied by appropriate selection of external circuitry (Rv, Rg) for the amplification factor V pregiven by the conditioning circuit (5, 13).

It is understood that the foregoing description is that of the preferred embodiments of the invention and that various changes and modifications may be made thereto without departing from the spirit and scope of the invention as defined in the appended claims.

What is claimed is:

1. A circuit arrangement for conditioning a signal (U1) of a measuring sensor having a ground potential so that said sensor signal (U1), which is referred to said ground potential, can be further processed in a control apparatus having a control apparatus ground potential which can be offset from said ground potential of said measuring sensor by an amount (Um), the circuit arrangement comprising:

a conditioning circuit including: a first input connected to said sensor ground and a first output; means for generating a first offset Ug; and, means for forming a sum potential of said ground potential of said measuring sensor and said first offset Ug and for applying said sum potential to said first output;

coupling means for logically combining said sum potential and said sensor signal (U1) to define a signal (Ue) as a linear function of said sensor signal (U1) supplemented by an offset (b) other than zero and said signal (Ue) being defined by the equation:

$$Ue=a'Ul+b$$

wherein said signal Ue is referred to said ground potential of said measuring sensor;

said conditioning circuit further including a second input for receiving said signal (Ue) to form a potential at said second input corresponding to a potential (Ue+Um) referred to said control apparatus ground; and, ancillary means having a first input for receiving said potential (Ue+Um) via said second input of said conditioning circuit and having a second input for receiving said ground potential of said control apparatus; and, said ancillary means including means for converting said potential (Ue+Um) and said ground potential of said control apparatus into an output signal (Ua), which is referred to said ground potential of said control apparatus and is independent of said amount (Um) and is a linear function of said measuring signal (U1) with an offset B defined as:

$$Ua=A'Ul+B$$

wherein said offset B can be set to a value zero or to a value other than zero in dependence upon the configuration of said coupling means; and, said conditioning circuit having a second output for outputting said output signal Ua.

2. The circuit arrangement of claim 1, said coupling means comprising:

an input for receiving said signal (U1) of said measuring sensor;

first and second resistors (Rv, Rg) defining a voltage divider and being connected in series between said input of said coupling means and said first output of said conditioning circuit; and, said voltage divider having a tap between said first and second resistors (Rv, Rg) at which said signal (Ue) is taken off.

3. The circuit arrangement of claim 1, wherein said amount Um is a ground offset; and, said ancillary means further comprising:

a circuit component having an input/output function corresponding to an operational amplifier having a resistance network, non-inverting and inverting inputs and an output;

said resistance network including a series circuit of first resistor k*R and second resistor R/n connected between the output of said operational amplifier and said ground of said measuring sensor, said resistance network also including a third resistor R connected to a circuit node connecting said first and second resistors (k*R, R/n) to each other;

means for forming and applying a signal U2 to said non-inverting input, said signal U2 being a composite signal made up of: a signal V*Ue proportional to said signal Ue and to which said amount Um is added to define a sum weighted by a proportionality factor (d<1) so that said signal U2, referred to said ground potential of said measuring sensor, is defined by U2=d*(V*Ue+Um)−Um;

said inverting input of said operational amplifier being connected to said circuit node between said first and second resistors (k*R, R/n) thereby applying the potential of said circuit node to said inverting input; and, said potential on said circuit node being connected via said third resistor R to a means for conditioning an offset U1 referred to said ground of said measuring sensor.

4. The circuit arrangement of claim 3, further comprising amplification means connected upstream of said circuit component for amplifying said signal Ue by a factor V.

5. The circuit arrangement of claim 3, said factor d being determined by a voltage divider connected between said signal Ue and the ground potential of said control apparatus.

6. The circuit arrangement of claim 5, wherein the factors d, k and n satisfy the equation (l+k+k*n)=1/(1−d) thereby ensuring that the output voltage Ua of said operational amplifier measured with respect to the ground potential of said control apparatus is independent of said ground offset Um between said ground potential of said control apparatus and said ground potential of said measuring sensor.

7. The circuit arrangement of claim 1, wherein said amount Um is a ground offset; and, said ancillary means further comprising:

a circuit component having an input/output function corresponding to an operational amplifier having a resistance network, non-inverting and inverting inputs and an output;

said resistance network including a series circuit of a first resistor k*R and a second resistor R and being connected between the output of said operational amplifier and the sum of the ground potential Um of said measuring sensor and an offset U1 of said measuring sensor which is adjusted with respect to said potential Um;

means for forming and applying a signal U2 to said non-inverting input, said signal U2 being a composite signal made up of: a signal V*Ue proportional to said signal Ue and to which said ground offset Um is added to define a sum weighted by a proportionality factor (d<1) so that U2, referred to said ground potential of said measuring sensor, is defined by U2=d*(V*Ue+Um)−Um;

said first and second resistors k*R and R being connected to each other by a circuit node; and, said inverting input of said operational amplifier being connected to said circuit node between said first and second resistors (k*R, R) thereby applying the potential of said circuit node to said inverting input.

8. The circuit arrangement of claim 1, wherein the offset fixedly adjusted with respect to said ground potential of said measuring sensor is obtained by a voltage division of the voltage Ug.

9. A circuit arrangement for conditioning a signal (U1) of a measuring sensor having a ground potential so that said sensor signal (U1), which is referred to said ground potential, can be further processed in a control apparatus having a control apparatus ground potential which can be offset from said ground potential of said measuring sensor by an amount (Um), the circuit arrangement comprising:

a conditioning circuit including: a first input connected to said sensor ground and a first output; means for generating a first offset Ug; and, means for forming a sum potential of said ground potential of said measuring sensor and said first offset Ug and for applying said sum potential to said first output;

coupling means for logically combining said sum potential and said sensor signal (U1) to define a signal (Ue) as a linear function of said sensor signal (U1) supplemented by an offset (b) other than zero and said signal (Ue) being defined by the equation:

$$Ue=a*Ul+b$$

wherein said signal Ue is referred to said ground potential of said measuring sensor;

said conditioning circuit further including a second input for receiving said signal (Ue) to form a potential at said second input corresponding to a potential (Ue+Um) referred to said control apparatus ground; and, ancillary means having a first input for receiving said potential (Ue+Um) via said second input of said conditioning circuit and having a second input for receiving said ground potential of said control apparatus; and, said ancillary means including means for converting said potential (Ue+Um) and said ground potential of said control apparatus into an output signal (Ua), which is referred to said ground potential of said control apparatus and is independent of said amount (Um) and is a linear function of said measuring signal (U1) with an offset B defined as:

$$Ua=A*Ul+B$$

wherein said offset B can be set to a value zero or to a value other than zero in dependence upon the configuration of said coupling means; and, said conditioning circuit having a second output for outputting said output signal Ua so that, when said offset B is set to zero, errors of said first offset Ug or of said offset (b) resulting therefrom are completely eliminated.

10. The circuit arrangement of claim 9, wherein said amount Um is a ground offset; and, said ancillary means further comprising:

a circuit component having an input/output function corresponding to an operational amplifier having a resistance network, non-inverting and inverting inputs and an output;

said resistance network including a series circuit of a first resistor k*R and a second resistor R connected between the output of said operational amplifier and the sum of the ground potential Um of said measuring sensor plus a voltage c*Ug;

said first resistor k*R and said second resistor R being connected to each other at a connecting node;

means for applying a voltage to said non-inverting input which is present at said connecting node;

means for applying a signal U2 to said non-inverting input; and, said signal U2 being a composite signal made up of: a signal V*Ue proportional to said signal Ue and to which said ground offset Um is added to define a sum weighted by a proportionality factor (d<1) so that U2, referred to said ground potential of said measuring sensor, is defined by U2=d*(V*Ue+Um)−Um.

* * * * *

UNITED STATES PATENT AND TRADEMARK OFFICE
CERTIFICATE OF CORRECTION

PATENT NO. : 5,460,028

DATED : October 24, 1995

INVENTOR(S) : Peter Werner, Hermann Hemminger, Beate Glöckner, Gerard Byrne and Stephan Johne

It is certified that error appears in the above-identified patent and that said Letters Patent is hereby corrected as shown below:

In column 2, line 63: delete "Ue=Ui+Uo+Uf=>Ua=X*(Ue+Uo+Uf)-X*(Uo+Uf)" and substitute -- Ue=Ul+Uo+Uf=>Ua=X*(Ue+Uo+Uf)-X*(Uo+Uf) -- therefor.

In column 2, line 67: delete "(U1)" and substitute -- (Ul) -- therefor.

In column 3, line 1: delete "(U1)" and substitute -- (Ul) -- therefor.

In column 3, line 12: delete "(U1)" and substitute -- (Ul) -- therefor.

In column 3, line 13: delete "(U1)" and substitute -- (Ul) -- therefor.

In column 3, line 15: delete "Ue=a*U1+b" and substitute -- Ue=a*Ul+b -- therefor.

In column 3, line 29: delete "(U1)" and substitute -- (Ul) -- therefor.

In column 3, line 29: delete "Ua=A*U1+B" and substitute -- Ua=A*Ul+B -- therefor.

In column 4, line 8: delete "U1" and substitute -- Ul -- therefor.

UNITED STATES PATENT AND TRADEMARK OFFICE
CERTIFICATE OF CORRECTION

PATENT NO. : 5,460,028

DATED : October 24, 1995

INVENTOR(S) : Peter Werner, Hermann Hemminger, Beate Glöckner, Gerard Byrne and Stephan Johne

It is certified that error appears in the above-identified patent and that said Letters Patent is hereby corrected as shown below:

In column 4, line 27: delete "U1" and substitute -- Ul -- therefor.

In column 4, line 30: delete "U1" and substitute -- Ul -- therefor.

In column 4, line 31: delete "(Ue=a*U1+b)." and substitute -- (Ue=a*Ul+b). -- therefor.

In column 4, line 58: delete "U1 (Ua=A*U1)." and substitute -- Ul (Ua=A*Ul). -- therefor.

In column 4, line 62: delete "(Ua=A*Ui+B)" and substitute -- (Ua=A*Ul+B) -- therefor.

In column 4, line 63: delete "U1" and substitute -- Ul -- therefor.

In column 4, line 67: delete "U1" and substitute -- Ul -- therefor.

In column 5, line 1: delete "U1-Ug" and substitute -- Ul-Ug -- therefor.

In column 5, line 3: delete "U1" and substitute -- Ul -- therefor.

UNITED STATES PATENT AND TRADEMARK OFFICE
CERTIFICATE OF CORRECTION

PATENT NO. : 5,460,028

DATED : October 24, 1995

INVENTOR(S) : Peter Werner, Hermann Hemminger, Beate Glöckner, Gerard Byrne and Stephan Johne

It is certified that error appears in the above-identified patent and that said Letters Patent is hereby corrected as shown below:

In column 5, line 37: delete "Ua=U'a+Um=(1+k+k*n)*((V*Ue+Um)*d-Um)-k*Ug+Um." and substitute -- Ua=U'a+Um=(1+k+k*n)*((V*Ue+Um)*d-Um)-k*Ug+Um. -- therefor.

In column 5, line 48: delete "Ua=(1+k+k*n)(V*Ue)-k*Ug" and substitute -- Ua=(1+k+k*n)(V*Ue)-k*Ug -- therefor.

In column 6, line 3: delete "(1+k+k*n)*V*b=k*Ug," and substitute -- (1+k+k*n)*V*b=k*Ug, -- therefor.

In column 6, line 4: delete "Ua=A*U1" and substitute -- Ua=A*Ul -- therefor.

In column 6, line 5: delete "(1+k+k*n)*V*a." and substitute -- (1+k+k*n)*V*a. -- therefor.

In column 6, line 6: delete "Rv/(Rv+Rg)=k/(1+k+k*n)." and substitute -- Rv/(Rv+Rg)=k/(1+k+k*n). -- therefor.

In column 6, line 11: delete "U1" and substitute -- Ul -- therefor.

In column 6, line 57: delete "(U1)" and substitute -- (Ul) -- therefor.

In column 6, line 59: delete "(U1)," and substitute -- (Ul), -- therefor.

UNITED STATES PATENT AND TRADEMARK OFFICE
CERTIFICATE OF CORRECTION

PATENT NO. : 5,460,028

DATED : October 24, 1995

INVENTOR(S) : Peter Werner, Hermann Hemminger, Beate Glöckner, Gerard Byrne and Stephan Johne

It is certified that error appears in the above-identified patent and that said Letters Patent is hereby corrected as shown below:

In column 7, line 4: delete "(U1)" and substitute -- (Ul) -- therefor.

In column 7, line 5: delete "(U1)" and substitute -- (Ul) -- therefor.

In column 7, line 8: delete "Ue=aUl+b" and substitute -- Ue=a*Ul+b -- therefor.

In column 7, line 26: delete "(U1)" and substitute -- (Ul) -- therefor.

In column 7, line 29: delete "Ua=AUl+B" and substitute -- Ua=A*Ul+B -- therefor.

In column 7, line 38: delete "(U1)" and substitute -- (Ul) -- therefor.

In column 8, line 9: delete "U1" and substitute -- Ul -- therefor.

In column 8, line 35: delete "U1" and substitute -- Ul -- therefor.

In column 8, line 57: delete "(U1)" and substitute -- (Ul) -- therefor.

UNITED STATES PATENT AND TRADEMARK OFFICE
CERTIFICATE OF CORRECTION

PATENT NO. : 5,460,028

DATED : October 24, 1995

INVENTOR(S) : Peter Werner, Hermann Hemminger, Beate Glöckner, Gerard Byrne and Stephan Johne

It is certified that error appears in the above-identified patent and that said Letters Patent is hereby corrected as shown below:

In column 8, line 59: delete "(U1)," and substitute -- (Ul), -- therefor.

In column 9, line 4: delete "(U1)," and substitute -- (Ul), -- therefor.

In column 9, line 5: delete "(U1)," and substitute -- (Ul), -- therefor.

In column 9, line 26: delete "(U1)," and substitute -- (Ul), -- therefor.

Signed and Sealed this

Third Day of September, 1996

*Attest:*

Bruce Lehman

BRUCE LEHMAN

*Attesting Officer*

*Commissioner of Patents and Trademarks*